United States Patent [19]

Cooper

[11] 4,272,044

[45] Jun. 9, 1981

[54] KITE CONSTRUCTION

[75] Inventor: Wayne L. Cooper, Maroa, Ill.

[73] Assignee: The Hi-Flier Manufacturing Company, Decatur, Ill.

[21] Appl. No.: 82,414

[22] Filed: Oct. 5, 1979

[51] Int. Cl.[3] ..... B64C 31/06

[52] U.S. Cl. ..... 244/153 R

[58] Field of Search ..... 244/153 R, 154, 155 R, 244/155 A

[56] References Cited

U.S. PATENT DOCUMENTS

| | | | |
|---|---|---|---|
| 71,232 | 11/1867 | Shepard . | |
| D. 196,057 | 8/1963 | Levine | D34/15 |
| 368,525 | 8/1887 | Fleharty . | |
| 608,823 | 8/1898 | Baker | 244/153 R |
| 646,375 | 3/1900 | Eddy | 244/153 R |
| 1,014,369 | 1/1912 | Buengers . | |
| 1,131,076 | 3/1915 | Patchel | 244/153 R |
| 2,442,417 | 6/1948 | Lang | 244/153 R |
| 2,463,135 | 3/1949 | Bach | 244/153 |
| 2,472,137 | 6/1949 | Winslow | 244/153 R |
| 2,800,293 | 7/1957 | Kindelberger et al. | 244/155 |
| 2,986,363 | 5/1961 | Vandegrift | 244/153 |
| 3,241,793 | 3/1966 | Curtis et al. | 244/153 R |

FOREIGN PATENT DOCUMENTS

| | | | |
|---|---|---|---|
| 2116424 | 10/1972 | Fed. Rep. of Germany | 244/153 R |

*Primary Examiner*—Galen L. Barefoot

*Attorney, Agent, or Firm*—Kenway & Jenney

[57] ABSTRACT

A kite with a crossed-stick frame has a bracket secured to the sticks and which supports the kite skin in an aerodynamic configuration. The bracket has a folded body that wraps around one frame stick and seats another in holes on either side of the fold. Webs on the bracket span from this engagement with the frame to deflect the kite skin away from the frame into a desired aerodynamic configuration.

15 Claims, 5 Drawing Figures

KITE CONSTRUCTION

BACKGROUND

This invention provides a new construction for a kite and provides a new bracket for assembling a kite.

The invention is applicable to a kite of type having a crossed-stick frame that supports the kite skin with a substantially planar periphery. A common example of such a kite is the well-known two-stick kite, which has a single-sheet skin supported on a frame formed by two crossed sticks. This kite construction with a planar skin periphery is in contrast to other known configurations, such as a box kite and a keel kite, in which the periphery of the kite skin is spaced along three directions and hence is non-planar.

The conventional assembly for the common two-stick kite involves securing the kite skin to the ends of the two crossed sticks, typically by seating a string secured to the periphery of the skin into slots at the ends of each stick. The horizontal stick is bowed by a taut string extending between its ends in order to deflect the kite skin into an aerodynamic configuration. A bridal string is connected between the ends of the vertical stick, and the kite string with which the kite is tethered is secured to the bridal string.

A two-stick kite assembled in this manner often fails to fly well because the horizontal stick is improperly bowed and hence the kite skin does not have the proper aerodynamic configuration. Other reasons for difficulty are that the length of the bridal string is incorrect, and that the tether is secured to the wrong place along bridal string. The net result is that the kite is improperly configured for proper wind support and hence flies poorly, if at all. Despite these shortcomings, the two-stick kite long has had appeal, due at least in part to its simplicity and comparatively low cost.

It is an object of this invention to provide an improved construction for a crossed-stick kite which simplifies the assembly and which simplifies attaining the proper aerodynamic configuration of the kite skin.

Another object of the invention is to provide a crossed-stick kite construction which automatically provides the proper aerodynamic configuration, and which ensures proper location of the connection of the tether to the kite. A further object is to eliminate the need for a bridal string as found on prior two-stick kites.

It is also an object of the invention to provide a bracket for assembling a crossed-stick kite and which provides the kite with the foregoing features.

Other objects of the invention will in part be obvious and will in part appear hereinafter.

SUMMARY OF THE INVENTION

A kite according to the invention has a bracket with a folded body, typically of thin paperboard or like relatively stiffly resilient sheet stock. The folded bracket secures one frame stick seated in the crease by means of a second frame stick seated in holes through web portions of the bracket on either side of the crease. At least one web portion, and preferably both of them, are sufficiently wide to press the kite skin forward, away from the crossed sticks, into the proper aerodynamic configuration for flying the kite.

The bracket includes an anchorage for receiving the string by which the kite is tethered. The anchorage preferably includes a tab projecting on one web portion away from the crease so as to pass through a hole or slot in the kite skin to be accessible from the front of the kite skin, where the tether is tied to it.

A two-stick kite employing this construction accordingly has the two kite sticks securely held together at right angles to one another by virtue of the anchorage which the bracket provides. The web portions of the bracket position the kite skin in the proper aerodynamically-bowed configuration, which includes the proper dihedral angle between the two portions of the kite skin on either side of the vertical kite stick. The anchorage of the tether to the bracket fixes the point of attachment at the proper location, by virtue of the fixed location of the kite sticks relative to the bracket.

The single bracket thus ensures both the proper aerodynamic configuration and the proper anchorage point so that the kite is automatically aerodynamically balanced, except for whatever weight is needed by a tail. Consequently, a two-stick kite constructed in this manner retains the high degree of simplicity and elegence of common classical constructions, in addition to having the proper configuration and deployment that enhances ease of flying, even under a variety of wind conditions. The invention attains these advantages and features with a bracket that is relatively inexpensive and light in weight, and yet which is easier to use than the prior conventional techniques of assembling a two-stick kite.

The invention accordingly comprises the features of construction, combination of elements, and arrangement of parts exemplified in the constructions hereinafter set forth, and the scope of the invention is indicated in the claims.

For a fuller understanding of the nature and objects of the invention, reference should be made to the following detailed description and the accompanying drawings, in which.

Figure 1:
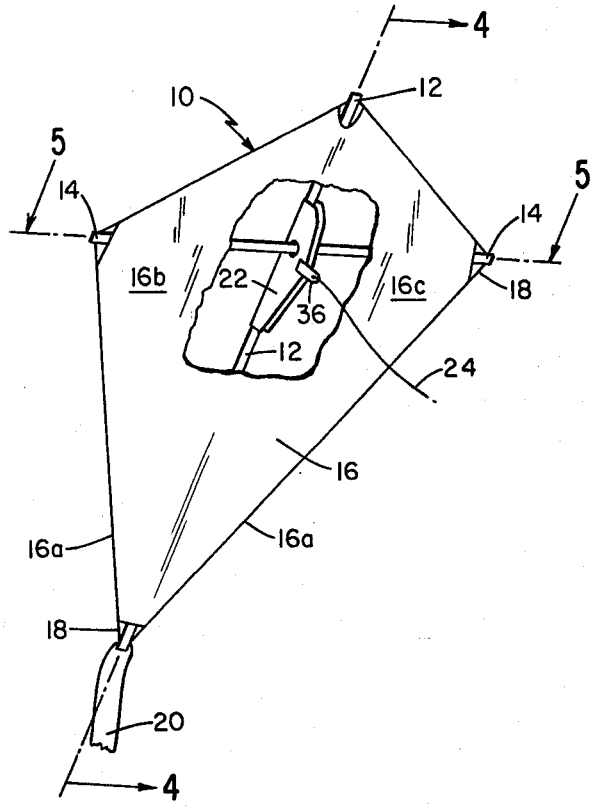
FIG. 1 shows a two-stick kite, with the skin partly broken away, embodying features of the invention.
Figure 4:
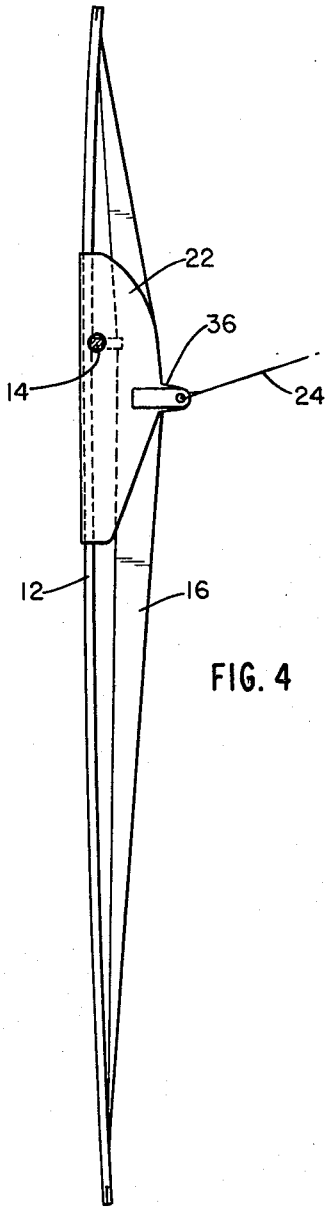
Figure 2:
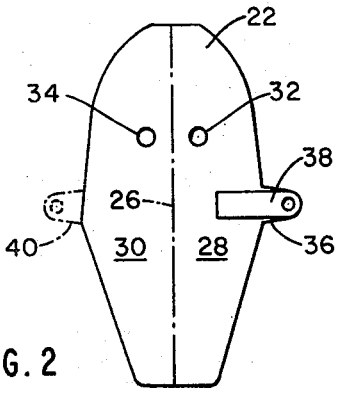
FIG. 2 is a plan view of a kite bracket according to the invention.
Figure 3:
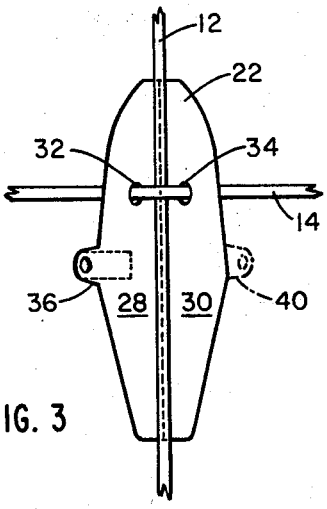
FIG. 3 is a plan view of the bracket of FIG. 2 from the opposite side and partially folded for initial assembly with two kite sticks.
Figure 5:
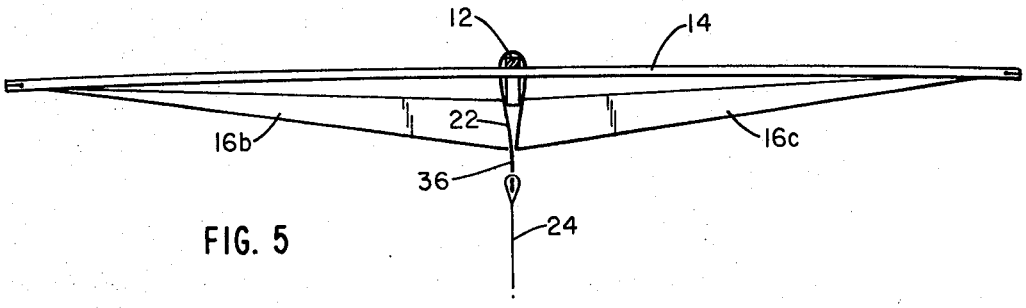

FIG. 4 is a cross-sectional, side elevation view of the kite of FIG. 1 with the bracket of FIGS. 2 and 3 and taken along line 4—4 of FIG. 1; and FIG. 5 is a transverse cross-sectional view of the kite of FIG. 1 taken along line 5—5.

DESCRIPTION OF ILLUSTRATED EMBODIMENT

With specific reference to the drawings, a two-stick kite 10 according to the invention has a frame formed with two crossed sticks 12 and 14 and has a skin 16. A string 18 is secured to the peripheral edge **16*a* of the kite skin and is fastened to the sticks, thereby supporting the skin stretched out, by seating four exposed corners of the skin in slots in the ends of the sticks. The skin of the kite is hence substantially planar at the peripheral edge 16*a*. This construction and assemblage of the kite, which typically includes a tail 20 fastened to the lower end of the vertical stick 12**, is conventional.

The kite 10 also has a bracket 22 secured to the frame sticks 12 and 14 and pressing the kite skin away from the crossed sticks to the aerodynamic configuration required for the kite to fly. As also shown, the bracket 22 provides a properly located anchorage for the tether 24.

The illustrated bracket 22 is, as FIG. 2 shows, a sheet of stiffly resilient stock, typically paperboard, having a longer dimension along which it is scored with a crease line 26 to define two conjoined web portions 28 and 30. The width of each web portion tapers from a minimum value at the longitudinal ends of the crease line 26 to a maximal value substantially at the longitudinal center of the bracket. The lateral edges of the illustrated web portions are straight, except that the upper one-third or so of the length is concavely rounded, as FIG. 2 shows. A hole 32, 34 apertures each web portion 28, 30 respectively; the holes are at equal spacings from the crease line 26. The holes are aligned opposite one another and have a diameter selected to receive the horizontal frame stick 14 with a close fit; a slight interference fit is preferred. The spacing of each hole from the crease line 26 is selected to receive the vertical frame stick 12 clamped between the fold along crease line 26 and the horizontal stick, when it is inserted in the holes, as FIGS. 1 and 3 show. FIG. 2 shows the bracket 22 laid out flat, and in FIG. 3 it is partially folded. Upon further folding of the bracket to complete the kite assembly, the bracket has the configuration shown in FIGS. 1, 4 and 5.

In this configuration, the fold in the bracket seats the vertical stick 12 with elongated engagement, and the holes 32 and 34 seat the horizontal stick 14 fixed at right angles to the vertical stick and clamping the latter stick in the fold. Each bracket web portion 28 and 30 extends, as shown in FIGS. 1, 4, and 5, essentially transversally to both kite sticks and to the kite skin. It spans between the sticks and the skin and, as noted, is compressed therebetween. Forward edges of the web portions 28 and 30 compressively bear against the kite skin, as FIGS. 4 and 5 show, which deflects the skin away from the intersection of the two frame sticks. This deflection, which bows each stick as indicated, places the kite skin in an aerodynamic configuration as needed for flying the kite. This configuration includes a bowing of the skin to define two side-by-side wing-like portions **16*b* and 16*c* disposed symmetrically on either side of a plane parallel to FIG. 4 and passing through the vertical stick 12. As shown in FIG. 5, the width of the bracket web portions determines the dihedral angle of these wing portions 16*b* and 16*c*. The kite construction hence provides the proper dihedral simply by the dimensions of the bracket 22. The bracket also bows each wing portion to provide upper and lower segments inclined relative to one another on either side of a plane parallel to FIG. 5** and passing through the widest span of the bracket web portions.

The illustrated bracket 22 provides the anchorage for the kite-tethering line 24 with an apertured tab 36 that projects from the web portion 28 in the direction transverse to the crease line 26. The tab is sufficiently long to project through a slit in the kite skin 16 to be accessible at the front of the kite, as FIGS. 4 and 5 show, for tying the line to it. It is often desirable to reinforce the tab, to prevent the tether line 24 from tearing from the tab hole, with a reinforcing tape 38 or like adhesive strengthening member which encircles the tab hole, as shown. Also, the bracket can be provided with a second tether-anchoring tab 40 projecting from the other web portion 30, as FIGS. 2 and 3 show with dashed lines. Where the second tab 40 is provided, both tabs project through a single slot in the kite skin, and the tether 24 is threaded through the holes in both tabs and tied to them jointly.

By way of illustrative example, a two-stick kite as shown in FIG. 1 having a horizontal stick 14 and a vertical stick 12 has a bracket 22 made of paperboard with an overall length along the crease line of twenty-five centimeters. The width of the bracket at the widest point, which is the location of the tab 36 (but excluding the length of that tab), is approximately one-half of the overall length of the bracket along its center line, the tab 36 is located approximately at the longitudinal mid-point of the bracket, and the holes 32 and 34 which receive the horizontal kite stick 14 are located approximately one-quarter of the bracket length from the longitudinal location of the tab. This specific example is by way of illustration only, and other geometries, including dimensions, can be used within the scope of the invention in accordance with the design of the specific crossed-stick kite with which the bracket is to be used.

Moreover, although illustrated and described with reference to a two-stick kite, the invention can be practiced with kites having more than two sticks. By way of example, a folded bracket similar to that illustrated can be used in a kite having three sticks which cross at their mid-points; one stick is laid in the crease of the bracket in the manner illustrated, and the other two sticks pass through holes in each web portion of the bracket. Such a kite typically has a skin with a six-sided periphery; U.S. Pat. No. 71,232 shows a kite of this geometry but using a different bracket. The invention can also be used with a crossed stick kite of the form shown in German Pat. No. 2,116,424. This patent illustrates a prior art bracket which supports two crossed sticks and receives one end of a bridal cord.

Although it is considered preferable, it is not required that the bracket have two web portions as illustrated. Instead, where desired for savings in cost or weight or otherwise, one web portion can be omitted, leaving only the base thereof which forms the stick-receiving fold and the stick-receiving hole, e.g. hole 34.

The invention thus provides a new construction for crossed-stick kites of the kind where the periphery of the kite skin is generally planar. The new construction employs a folded bracket arranged to support one kite stick seated in the fold or crease and a second kite stick seated in holes which aperture the two web portions on either side of the crease in a manner to hold the former kite stick seated in the crease. At least one web portion extends sufficiently from the crease to compressively bear against the skin of the kite in a manner that supports it deflected in the aerodynamic configuration desired for the kite. Preferably the two web portions are symmetrical and both bear against the kite skin. The kite construction secures the tether to one or both of the bracket web portions; preferably a tab projects from a web portion through the kite skin and receives the line at the front of the kite.

This kite construction is quick and easy to assemble, requires no string or other tension member to bow a kite stick to provide dihedral and other aerodynamic surfaces, and requires no bridal string. Instead, the bracket supports the kite sticks at the proper relative orientations, shapes the kite to provide the proper dihedral angle between wing portions of the kite skin, and provides the properly-located anchorage for the tether. A kite having this construction is properly balanced and aerodynamically shaped for flying. Further, the kite can be readily disassembled for storage by withdrawing the horizontal kite stick from the bracket and folding the kite skin around the vertical stick and the bracket. The invention attains these advantages at low cost and with minimal additional weight.

It will thus be seen that the objects set forth above, among those made apparent from the preceding description, are efficiently attained. Since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described, and all statements of the scope of the invention which as a matter of language might be said to fall therebetween.

Having described the invention, what is claimed as new and secured by Letters Patent is:

1. A kite having at least first and second crossed frame members mounting a skin and further comprising a bracket member secured to said frame members and supporting them in a crossed configuration, said bracket member having a web portion arranged with a span thereof compressed between both said first and second frame members and said skin, a peripheral edge of said web portion opposite said frame members contacting said skin to dispose said skin in an aerodynamic configuration having at least first and second portions inclined with a dihedral angle therebetween.

2. A kite as defined in claim 1 in which said bracket member includes means for mounting said frame members together with a selected orientation of one relative to the other.

3. A kite as defined in claim 1 in which said bracket member includes anchorage means for receiving a kite tethering line.

4. A kite as defined in claim 1 in which said bracket member comprises a stiffly-resilient sheet forming said web portion and having a fold therein arranged with said first frame member mountingly seated in said fold.

5. A kite as defined in claim 1 in which said bracket member comprises a stiffly-resilient sheet forming said web portion and arranged with said span thereof oriented transversely to both said frame members and said skin.

6. A kite as defined in claim 1 in which said bracket member further comprises a folded sheet portion adjoining said web portion and arranged with said first frame member mountingly seated in the fold thereof and further comprises means forming first and second frame-receiving holes, a first of which extends through said web portion and a second of which extends through the other side of the fold therefrom, said hole-forming means supportingly receiving said second frame member extending through said first and second holes with said second member clamping said first member between it and said fold.

7. A kite as defined in claim 3 in which said anchorage means includes a tab portion projecting from a first side of said skin where said frame members are located through said skin for receiving the kite tethering string at the other, opposite side of the kite skin.

8. A kite having at least first and second crossed frame members mounting a skin and further comprising a bracket member having a folded sheet forming at least a first web portion on one side of a longitudinal fold and arranged with the fold supportingly receiving said first frame member, having a hole in said web portion supportingly receiving said second frame member extending therein and having a peripheral edge of said web portion bearing against said skin for disposing said skin in a selected aerodynamic configuration and further having a span of said web portion extending between said member-receiving hole and said peripheral edge and being compressed therebetween.

9. A kite as defined in claim 8 in which said bracket member further comprises tab means projecting from said web portion away from the fold for passage through an opening in the kite skin for fasteningly receiving a kite tether line.

10. A kite as defined in claim 8 in which said bracket member has a second web portion arranged symmetrically about said fold with said first web portion and apertured with a hole supportingly receiving said second frame member and engaged with the kite skin adjacent the engagement thereof with said first web portion.

11. A kite as defined in claim 10 further comprising first and second tab portions each projecting from the same-numbered web portion for passage through an opening in the kite skin and each apertured for fasteningly receiving the kite tether line.

12. A kite bracket member comprising a stiffly-resilient sheet having a longitudinal fold for forming a first web portion on one side of said fold and having an aperture through said web portion, said bracket member being arranged for supportingly receiving a first kite frame member seated in said longitudinal fold and for receiving a second kite frame member extending through said aperture, and further having a web periphery spaced from said fold with said aperture intermediate said fold and said web periphery and with said web portion spanning between said web periphery and said aperture, said web portion being arranged for abutting engagement of said web periphery with a kite skin for disposing the kite skin spaced by the span of said web portion from the fold in an aerodynamic kite configuration.

13. A kite bracket member as defined in claim 12 further comprising a second web portion symmetrical with said first web portion about said longitudinal fold and having an aperture therein for also receiving the second kite frame member arranged with the first kite frame member seated between the second kite frame member and the bracket fold, said second web portion having a periphery arranged for abutting engagement with a kite skin adjacent the engagement thereof by said first web portion.

14. A kite bracket member as defined in claim 12 further comprising means forming a tether anchorage to said first web portion selectively located relative to said fold and to said aperture through said first web portion.

15. A kite bracket member as defined in claim 12 further comprising a first tab projecting from said web portion away from said fold for extension through an opening in a kite skin for fasteningly receiving a kite tether line from the side of the kite skin opposite to that at which said bracket member web portion is disposed.

* * * * *